US006577916B1

(12) United States Patent
Gehr et al.

(10) Patent No.: US 6,577,916 B1
(45) Date of Patent: Jun. 10, 2003

(54) METHOD OF CARRYING OUT AN OPTIMIZED FIBER OR PAPER MANUFACTURING PROCESS

(75) Inventors: Volker Gehr, Beienfurt (DE); Boris Reinholdt, Waldburg (DE); Thomas Köberl, Ravensburg (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 0 days.

(21) Appl. No.: 09/522,536

(22) Filed: Mar. 10, 2000

(30) Foreign Application Priority Data

Mar. 11, 1999 (DE) ..... 199 10 910

(51) Int. Cl.[7] ..... G06F 7/66; G05B 13/02; D21F 7/02

(52) U.S. Cl. ..... 700/129; 700/36; 700/53; 700/128; 162/252; 162/262

(58) Field of Search ..... 700/36, 53, 99, 700/122, 127–129, 142; 162/252, 253, 262, DIG. 10, DIG. 11

(56) References Cited

U.S. PATENT DOCUMENTS 5,249,120 A * 9/1993 Foley ..... 700/36
5,521,814 A * 5/1996 Teran et al. ..... 422/213
5,812,404 A * 9/1998 Hamalainen et al. ..... 162/252
6,128,540 A * 10/2000 Van Der Vegt et al. ..... 700/111
6,157,916 A * 12/2000 Hoffman ..... 702/182
6,319,362 B1 * 11/2001 Huhtelin et al. ..... 162/190
6,328,851 B1 * 12/2001 Huhtelin et al. ..... 162/190

FOREIGN PATENT DOCUMENTS

DE 196 53 479 9/1998

OTHER PUBLICATIONS

Jones, G.L., "Integration of process simulation with mill-wide information and control," *Tappi Journal*, Nov. 1990, pp. 113–118.
Skinner, J.E., "Real–time control of production costs," *Tappi Journal*, Jun. 1989, pp. 70–75.
English abstract of DE 196 53 479, 1 page.

* cited by examiner

*Primary Examiner*—Leo Picard
*Assistant Examiner*—Elliot Frank
(74) *Attorney, Agent, or Firm*—MacPherson Kwok Chen & Heid LLP

(57) ABSTRACT

A method of carrying out a fiber or paper manufacturing process using a plurality of successive method steps is provided. Defined process steps are carried out by means of predefinable chemical and physical sequences and process optimization is performed, wherein at least those characteristic variables of all the individual method steps which influence the target variables of the respective end product of the method in a significant way are registered on-line to control or optimize the overall process. Characteristic variables are formed both on the basis of the starting materials or raw materials and of the chemicals, auxiliaries and energy supplied in the successive method steps as well as of the materials and emissions to be disposed of.

12 Claims, 1 Drawing Sheet

METHOD OF CARRYING OUT AN OPTIMIZED FIBER OR PAPER MANUFACTURING PROCESS

Figure 1:
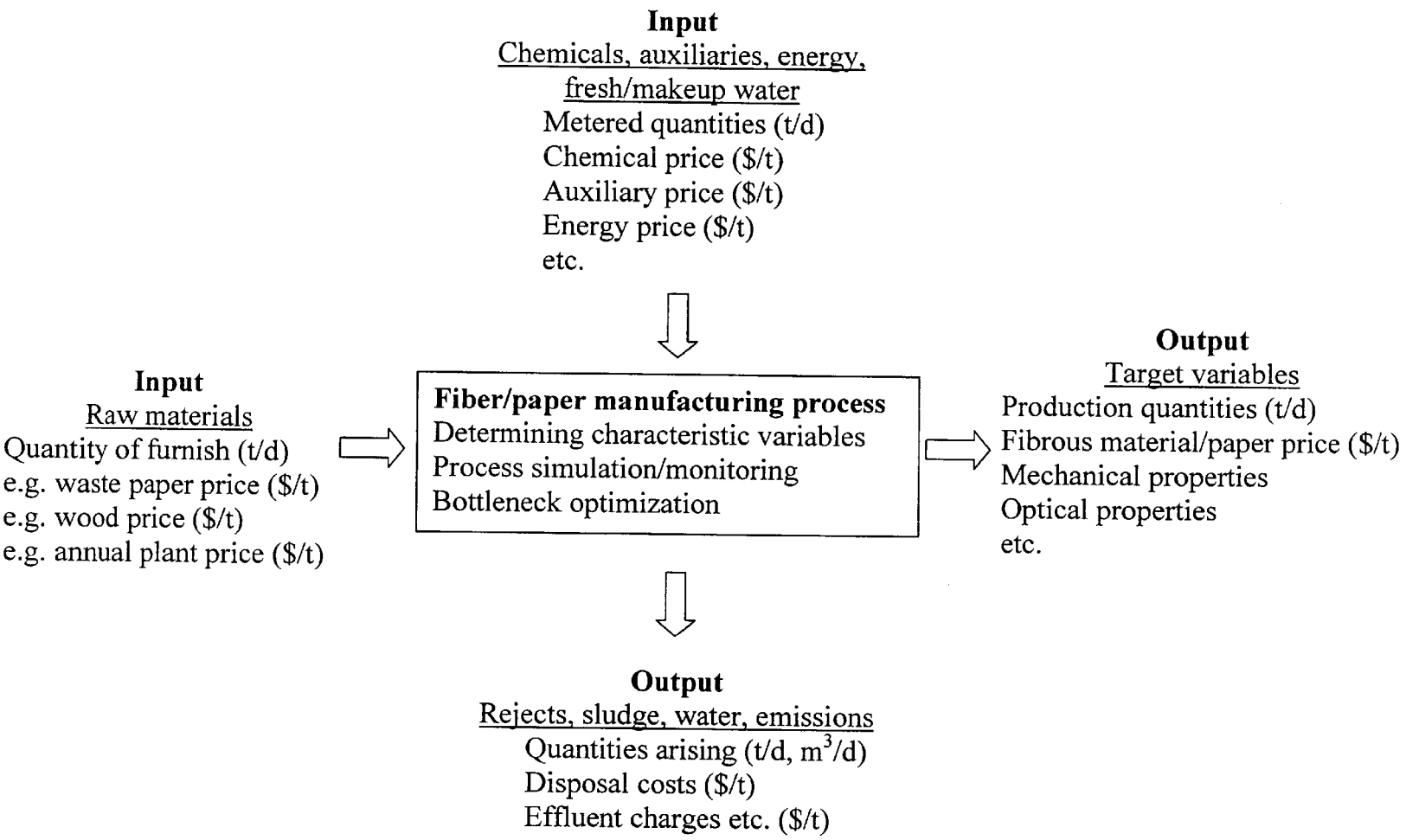

This application claims priority to German Application No. 199 10 910.0, filed on Mar. 11, 1999.

The invention relates to a method of carrying out a fiber or paper manufacturing process using a plurality of successive method steps in which defined process steps are carried out by means of predefinable chemical and physical sequences and process optimization is performed on the basis of measured values and characteristic values formed from the latter, if appropriate by using state models.

In the manufacture and preparation of fibrous materials, and also in paper manufacture, it is usual for a plurality of process steps to be connected in series, in order at the end of the overall process to obtain the respective product in a desired quality.

An important method step in the manufacture of paper is represented by the bleaching of fibrous materials. The respective stock, which may be, for example, groundwood, refiner stock and/or waste-paper stock, is subjected to bleaching operations in order to achieve the desired increase in the brightness of the stock without, in the process, impairing the strength of the respective stock in an undesired way. Since in the preparation of fibrous material or paper manufacture, significant importance is placed on the bleaching apparatus, normally consisting of a plurality of stages, to achieve desired qualities, attempts are already being made in practice to optimize the bleaching process. It is also already known to use optimization methods of this type in cooking processes in conjunction with the manufacture of chemical pulps. In this connection, it is known in particular to use state models and/or process models, specifically those based on registered mechanical, physical and/or chemical properties of the fibrous material or of the fibrous material suspension. Subprocesses of an overall process, such as the bleaching stage, are optimized using such state or process models.

The object of the invention is to optimize overall processes in the manufacture and preparation of fibrous materials or in paper manufacture both from technological points of view and also from economic and ecological points of view.

On the basis of the method specified at the beginning, according to the invention this is achieved by at least those characteristic variables of all the individual method steps which influence the target variables of the respective end product of the method in a significant way being registered on line and being used directly or indirectly on line to control or optimize the overall process, characteristic variables being formed both on the basis of the starting materials or raw materials and of the chemicals, auxiliaries and energy supplied in the successive method steps as well as of the materials and emissions to be disposed of.

In addition to the on line registration of characteristic variables, according to one design variant of the invention, off-line determination can also be performed so that, using the discrete values obtained here, on-line values are optimized within the context of an autocalibration module by means of computational models.

A significant special feature of the method according to the invention can also be seen in the fact that not only the determination of characteristic variables but also the monitoring and the control or optimization is carried out on line, to be specific preferably on the basis of known mathematical or economic algorithms, on the basis of fuzzy logic and the like.

A further significant aspect of the invention is that at least some, and preferably all, of the target and characteristic variables are transformed by means of a computational unit on a unitary basis. It is possible for a unitary basis to be a price per unit quantity determined via the determination of a cost or value. As a result of the conversion to a unitary basis, it is then also possible for a so-called bottleneck optimization to be carried out. From an economic point of view, the bottleneck problem is part of the production planning process. In this case, the products are designed via their price and quantity. On this basis, a mathematical target function is then defined and, as a rule, is designed as a profit or production maximization. However, it is also conceivable to define a function which, for example, has the objective of a reduced quantity of residual materials (waste) ($f(x_1+\ldots+x_n)$->MIN). These functions may be linear, but do not necessarily have to be. This actual target function, which can therefore be a maximization function, a minimization function or a combination of the two, can be restricted by ancillary conditions. The ancillary conditions can be formulated, for example, as a sales condition (for example upper sales limit) or a capacity condition (for example capacity bottleneck), which further restrict the target function. In addition, in the sense of the invention it is the case that both the target function and also the ancillary conditions are not formulated rigidly but are adapted to the respective conditions and requirements which result from the continuous operation (cf. Hax, H.: Lineare Planungsrechnung und Simplex-Methode als Instrument betrieblicher Planung [Linear planning calculation and simplex methods as an instrument of operational planning], in: ZfhF 1960, pp. 576 ff.).

Further advantageous embodiments and features of the invention are specified in the subclaims and will be explained below using an illustration of the principle.

FIG. 1, which shows an illustration of this principle, clarifies the relevant input and output variables in conjunction with a fiber/paper manufacturing process. The on line characteristic variable determination already discussed is carried out within the context of the overall process to be controlled or optimized, for which purpose mechanical, physical and/or chemical properties are registered by means of known methods at selected points in the overall process.

The raw materials supplied to the overall process are also registered in the form of the quantities of furnish, it being possible for a transformation of these variables on a unitary basis, for example on the basis of price per unit quantity, to be carried out, such as is also done for the other characteristic variables.

This applies also to the chemicals, auxiliaries and energy supplied during the overall process in the course of the control and optimization, as well as for fresh water and makeup water, it being possible for the corresponding metered quantities also to be transformed on a unitary basis, specifically in particular on the basis of price per unit quantity.

Also characteristic of the invention is the fact that, in addition to the target variables, the materials, especially rejects, sludge and water and emissions, which accumulate during the course of the method and have to be disposed of are registered and are used to control and optimize the overall process. These characteristic variables also have to be transformed on a unitary basis, so that the price given per unit quantity, for example for disposal costs and effluent charges, can also be taken into account.

The target variables are usually the product quantities, but according to the invention these can in turn be transformed on a unitary basis, so that mechanical properties and optical properties can also be taken into account as target variables. This is possible, for example, through the fact that the achievable price realized for the finished fibrous material and paper can be applied as a total parameter from all the optical and mechanical properties and selected properties.

As a result of the transformation of input and output characteristic or target variables on a unitary basis, the overall process can be optimized both from a technological point of view and from an economic and ecological point of view. As a result, it also becomes possible for the quantity of raw materials, the chemical costs, the auxiliary costs, the energy costs, the occurrence of waste and the disposal costs to be minimized. It is also possible to produce the respective semi-finished or finished stocks in such a way that the variance of the technological characteristic variables can be reduced quite considerably.

If the intention is to reduce the number of influencing variables in the overall model, it is possible for subprocesses, for example the pulping, bleaching, screening, fluctuation and the like in a waste-paper preparation plant, to be combined initially into independent modules, which they forward only a compressed number of characteristic variables to the overall process.

It is also of significant advantage for the design of the operation of an overall plant that, by using models which are capable of learning, the different influences of the inputs and outputs can be investigated in terms of the respective target variables and can be taken into account, and it is also possible to test various scenarios by changing the target and characteristic variables.

In the event that all the inputs and outputs are taken into account, the invention consequently permits control of the quality and regulation of the quality to be achieved, which has a positive influence both on the quality and on the economy of the relevant method and product.

What is claimed is:

1. A method of carrying out a fiber or paper manufacturing process using a plurality of successive method steps in which defined process steps are carried out by means of predefinable chemical and physical sequences and optimization of product properties including mechanical, optical or other selected products properties as target variables is performed on the basis of measured values and characteristic variables formed from said measured values, if appropriate by using state models, wherein said target variables and said characteristic variables are transformed on a unitary basis in the form of price per unit quantity and/or price per defined product quality and wherein said characteristic variables of all the individual method steps which influence the target variables of the respective end product of the method are registered online and are used directly or indirectly online to control or optimize the overall process, said characteristic variables being formed both on the basis of the starting materials or raw materials and of the chemicals, auxiliaries and energy supplied in the successive method steps as well as of the materials and emissions to be disposed of.

2. The method as claimed in claim 1, wherein in addition to the on line registration of characteristic variables, off-line determination of measured variables and characteristic variables is performed and, using the discrete values obtained, the respectively associated on line values are optimized by means of computational models.

3. The method as claimed in claim 1, wherein individual process steps or subprocesses are combined into independently controlled and optimized modules, and a compressed or reduced number of characteristic variables formed in these modules are used to control and optimize the overall process.

4. The method as claimed in claim 1, wherein at least some of the characteristic variables are weighted before they are used to control and optimize the overall process.

5. The method as claimed in claim 1, wherein bottleneck optimization in the overall process is carried out by using the characteristic variables transformed on a unitary basis.

6. The method as claimed in claim 1, wherein the characteristic variables are determined from the on line measured values by using mathematical or economic algorithms.

7. The method as claimed in claim 2, wherein individual process steps or subprocesses are combined into independently controlled and optimized modules, and a compressed or reduced number of characteristic variables formed in these modules are used to control and optimize the overall process.

8. The method as claimed in claim 2, wherein at least some of the characteristic variables are weighted before they are used to control and optimize the overall process.

9. The method as claimed in claim 3, wherein at least some of the characteristic variables are weighted before they are used to control and optimize the overall process.

10. The method as claimed in claim 7, wherein at least some of the characteristic variables are weighted before they are used to control and optimize the overall process.

11. The method as claimed in claim 2, wherein bottleneck optimization in the overall process is carried out by using the characteristic variables transformed on a unitary basis.

12. The method as claimed in claim 3, wherein bottleneck optimization in the overall process is carried out by using the characteristic variables transformed on a unitary basis.

* * * * *